US012779619B2

(12) United States Patent
Shiokawa et al.

(10) Patent No.: US 12,779,619 B2
(45) Date of Patent: Nov. 3, 2026

(54) POLISHING APPARATUS

(71) Applicant: EBARA CORPORATION, Tokyo (JP)

(72) Inventors: Yoichi Shiokawa, Tokyo (JP); Masaki Kinoshita, Tokyo (JP); Yuki Watanabe, Tokyo (JP); Toshifumi Kimba, Tokyo (JP); Keita Tanoue, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 240 days.

(21) Appl. No.: 18/544,073

(22) Filed: Dec. 18, 2023

(65) Prior Publication Data

US 2024/0278378 A1 Aug. 22, 2024

(30) Foreign Application Priority Data

Dec. 27, 2022 (JP) ..... 2022-210985

(51) Int. Cl.
*B24B 37/005* (2012.01)
*B24B 37/20* (2012.01)

(52) U.S. Cl.
CPC ..... *B24B 37/005* (2013.01); *B24B 37/20* (2013.01)

(58) Field of Classification Search
CPC ..... B24B 37/005; B24B 37/20; B24B 37/013; B24B 49/12; B24B 49/102
See application file for complete search history.

(56) References Cited

U.S. PATENT DOCUMENTS

| | | | | |
|---|---|---|---|---|
| 10,663,287 | B2 * | 5/2020 | Kimba | B24B 37/005 |
| 10,816,323 | B2 * | 10/2020 | Kimba | B24B 37/013 |
| 2009/0275264 | A1 | 11/2009 | Marxsen et al. | |

FOREIGN PATENT DOCUMENTS

| | | | |
|---|---|---|---|
| CN | 102509712 | A | 6/2012 |
| JP | 2002-261059 | A | 9/2002 |
| JP | 2010-023210 | A | 2/2010 |
| JP | 2011-258985 | A | 12/2011 |
| JP | 5167010 | B2 | 3/2013 |
| JP | 2014-011294 | A | 1/2014 |
| JP | 2015-020242 | A | 2/2015 |
| JP | 2019-079923 | A | 5/2019 |

(Continued)

*Primary Examiner* — Sabbir Hasan
(74) *Attorney, Agent, or Firm* — BakerHostetler

(57) ABSTRACT

A polishing apparatus that can improve an accuracy of position coordinates associated with a measured value of film thickness is disclosed. The polishing apparatus includes: a pad-thickness measuring device configured to measure a thickness of the polishing pad; an optical film-thickness measuring device configured to emit light obliquely to the substrate, and determine measured values of film thickness at measurement points; and a controller configured to associates the measured values of the film thickness with measurement coordinates indicating positions of the measurement points. The controller is configured to determine amount of movement of the measurement coordinates corresponding to a measured value of the thickness of the polishing pad based on correlation data indicating a relationship between the thickness of the polishing pad and the amount of movement of the measurement coordinates; and correct the measurement coordinates associated with the measured values of the film thickness based on the determined amount of movement of the measurement coordinates.

5 Claims, 10 Drawing Sheets

(56) References Cited

FOREIGN PATENT DOCUMENTS

| | | | |
|---|---|---|---|
| JP | 2019-528186 | A | 10/2019 |
| JP | 2021-030408 | A | 3/2021 |
| JP | 2022-158419 | A | 10/2022 |

* cited by examiner

POLISHING APPARATUS

CROSS REFERENCE TO RELATED APPLICATION

This document claims priority to Japanese Patent Application No. 2022-210985 filed Dec. 27, 2022, the entire contents of which are hereby incorporated by reference.

BACKGROUND

The manufacturing process of semiconductor devices includes a process of polishing a wafer to planarize the surface of the wafer. A known device for polishing a wafer is a polishing apparatus that performs chemical mechanical polishing (CMP). The polishing apparatus is configured to supply a polishing liquid onto a polishing surface of a polishing pad supported by a polishing table, press a wafer against the polishing surface, and move the wafer and the polishing table relative to each other to thereby polish the surface of the wafer.

A polishing performance of the polishing pad is lowered each time a wafer is polished. Therefore, the polishing apparatus performs dressing of the polishing pad in order to restore the polishing performance of the polishing pad. In the dressing operation, the polishing surface of the polishing pad is scraped off by a dresser to which hard abrasive grains, such as diamond particles, are fixed. As a result of the dressing operation, the polishing surface of the polishing pad is regenerated (in other words, the polishing performance of the polishing pad is restored).

Generally, the polishing apparatus includes a film-thickness measuring device for measuring a film thickness of a surface of a wafer during polishing. The polishing apparatus terminates the polishing operation when a measured value of the film thickness reaches a predetermined target value (in other words, a polishing end point). An example of the film-thickness measuring device is an optical film-thickness measuring device. The optical film-thickness measuring device has an optical sensor head. The optical sensor head emits light onto a measurement point on the surface of the wafer and receives reflected light from the surface of the wafer. The measured value of the film thickness is determined by analysis based on the reflected light. As the optical sensor head scans across the surface of the wafer, measured values of the film thickness are obtained at multiple measurement points on the surface of the wafer. These measured values of the film thickness are associated with position coordinates (i.e., measurement coordinates) indicating measurement positions on the surface of the wafer.

The polishing pad is worn out by polishing or dressing, and a thickness of the polishing pad gradually decreases. As the thickness of the polishing pad decreases, the surface of the wafer pressed against the polishing pad approaches the sensor head. As a result, the position of the measurement point of the sensor head after the thickness of the polishing pad has changed may be shift from that before the polishing pad changes. As a result, the position coordinates associated with the measured value of the film thickness may indicate a shifted position.

SUMMARY

Accordingly, there is provided a polishing apparatus that can improve an accuracy of position coordinates associated with a measured value of film thickness.

Embodiments, which will be described below, relate to a polishing apparatus.

In an embodiment, there is provided a polishing apparatus comprising: a polishing table configured to support a polishing pad, the polishing table being rotatable; a polishing head configured to press a substrate against a polishing surface of the polishing pad; a pad-thickness measuring device configured to measure a thickness of the polishing pad; an optical film-thickness measuring device configured to emit light obliquely to measurement points on the substrate, receive reflected light from the substrate, and determine measured values of film thickness at the measurement points based on the reflected light; and a controller configured to associates the measured values of the film thickness with measurement coordinates indicating positions of the measurement points, the controller including an arithmetic device configured to perform arithmetic operations including: determining amount of movement of the measurement coordinates corresponding to a measured value of the thickness of the polishing pad based on correlation data indicating a relationship between the thickness of the polishing pad and the amount of movement of the measurement coordinates; and correcting the measurement coordinates associated with the measured values of the film thickness based on the determined amount of movement of the measurement coordinates.

In an embodiment, the polishing pad-thickness measuring device is configured to measure the thickness of the polishing pad when the polishing pad-thickness measuring device is in contact with the polishing surface of the polishing pad.

In an embodiment, the polishing pad-thickness measuring device is arranged in the polishing table and is configured to measure the thickness of the polishing pad based on a height of a surface of the substrate that contacts the polishing surface.

In an embodiment, the optical film-thickness measuring device includes an optical sensor head configured to emit the light to the substrate and receive the light from the substrate, the polishing pad-thickness measuring device is configured to measure the thickness of the polishing pad based on the height of the surface of the substrate when both the polishing pad-thickness measuring device and the optical sensor head are covered by the substrate pressed against the polishing pad.

In an embodiment, the optical film-thickness measuring device includes a light-emitting optical fiber arranged to emit the light obliquely to the substrate, and a light-receiving optical fiber arranged to receive the light obliquely reflected off the substrate, and the light-emitting optical fiber has a diameter different from a diameter of the light-receiving optical fiber.

In an embodiment, there is provided a polishing apparatus comprising: a polishing table configured to support a polishing pad, the polishing table being rotatable; a polishing head configured to press a substrate against a polishing surface of the polishing pad, an optical film-thickness measuring device configured to emit light obliquely to measurement points on the substrate, receive reflected light from the substrate, determine measured values of film thickness at the measurement points based on the reflected light, and determine a quantity of received light; and a controller configured to associates the measured values of the film thickness with measurement coordinates indicating positions of the measurement points, the controller including an arithmetic device configured to perform arithmetic operations including: determining the thickness of the polishing pad corresponding to the quantity of received light based on first correlation data indicating a relationship between quantity of received light and thickness of the polishing pad; determining amount of movement of the measurement coordinates corresponding to the determined measured value of the thickness of the polishing pad based on second correlation data indicating a relationship between thickness of the polishing pad and amount of movement of the measurement coordinates; and correcting the measurement coordinates associated with the measured values of the film thickness based on the determined amount of movement of the measurement coordinates.

In an embodiment, there is provided a polishing apparatus comprising: a polishing table configured to support a polishing pad, the polishing table being rotatable; a polishing head configured to press a substrate against a polishing surface of the polishing pad; an optical film-thickness measuring device configured to emit light obliquely to measurement points on the substrate, receive reflected light from the substrate, determine measured values of film thickness at the measurement points based on the reflected light, and determine a quantity of received light; and a controller configured to associates the measured values of the film thickness with measurement coordinates indicating positions of the measurement points, the controller including an arithmetic device configured to perform arithmetic operations including: determining amount of movement of the measurement coordinates corresponding to the quantity of received light based on correlation data indicating a relationship between quantity of received light and amount of movement of the measurement coordinates; and correcting the measurement coordinates associated with the measured values of the film thickness based on the determined amount of movement of the measurement coordinates.

The controller is configured to correct the position coordinates corresponding to the measured value of the film thickness of the substrate by determining the amount of movement of the measurement point(s) using the correlation that is provided based on the thickness of the polishing pad. Therefore, the polishing apparatus can improve the accuracy of the position coordinates associated with the measured value of the film thickness.

DESCRIPTION OF EMBODIMENTS

First Embodiment

Figure 1:
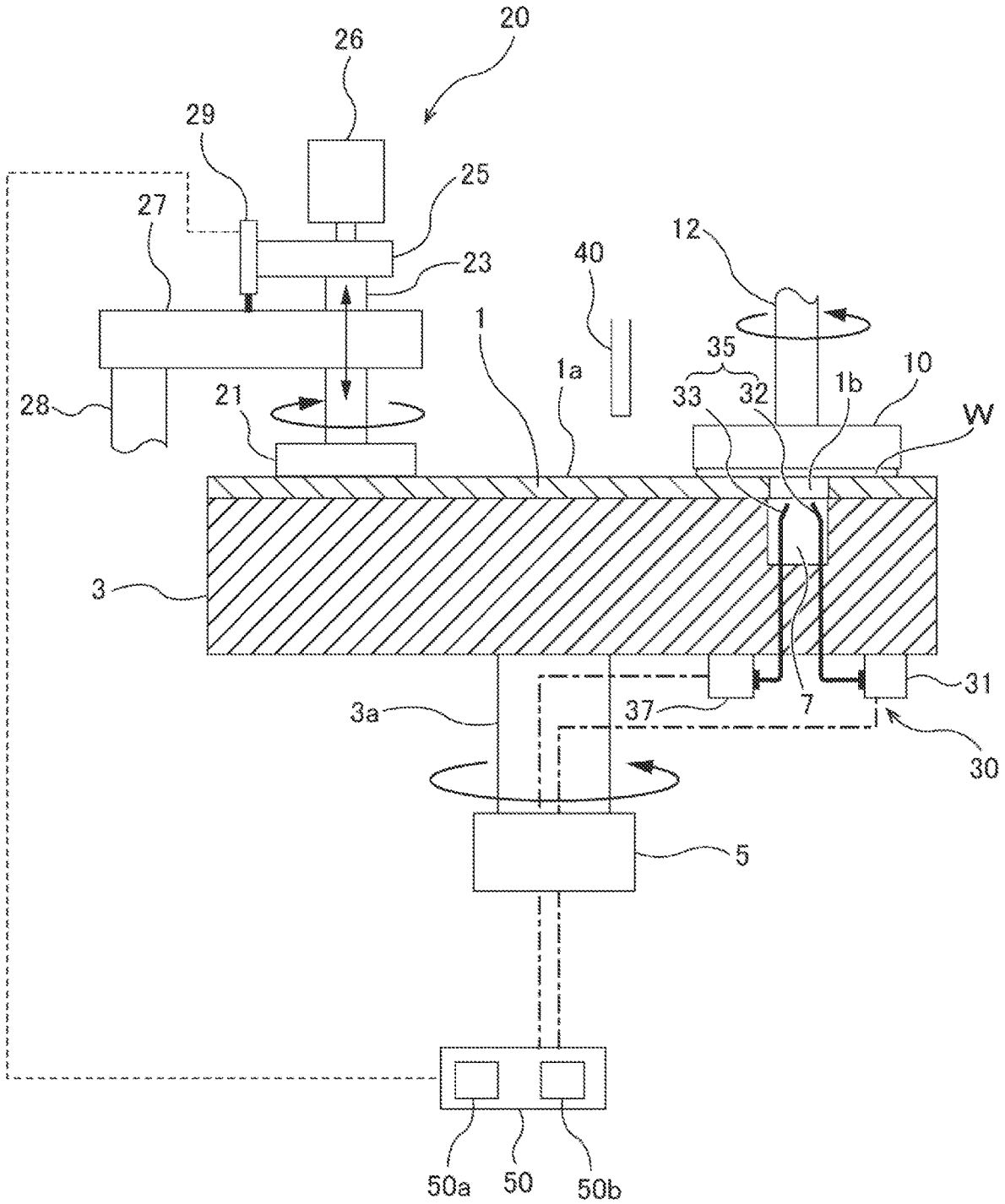
FIG. 1 is a diagram showing a polishing apparatus according to a first embodiment.

FIG. 1 is a diagram showing an embodiment of a polishing apparatus. The polishing apparatus shown in FIG. 1 is an apparatus configured to chemically and mechanically polish a workpiece, such as wafer, substrate, or panel. An example of polishing a wafer will be described below. The polishing apparatus includes a polishing pad 1, a polishing table 3 configured to support the polishing pad 1, a polishing-fluid supply nozzle 40 configured to supply a polishing liquid (for example, slurry containing abrasive grains) onto the polishing pad 1, a polishing head 10 configured to press a wafer W against the polishing pad 1, a dressing unit 20 configured to dress (condition) a polishing surface 1*a* of the polishing pad 1, an optical film-thickness measuring device 30 configured to measure a film thickness of the surface of the wafer W, and a controller 50 configured to control operations of these components.

The polishing pad 1 is attached to an upper surface of the polishing table 3. An upper surface of the polishing pad 1 constitutes the polishing surface 1*a* for polishing the wafer W. The polishing pad 1 has a thickness. Hereinafter, a distance from the top surface (i.e., the polishing surface 1*a*) of polishing pad 1 to a bottom surface (i.e., a surface attached to the upper surface of the polishing table 3) of polishing pad 1 will be referred to as the thickness of polishing pad 1. The polishing pad 1 has a through-hole 1*b* formed therein. A hole 7 is formed in the upper surface of the polishing table 3. The through-hole 1*b* and the hole 7 are in communication. As described later, the through-hole 1*b* allows light for measuring of a film thickness to pass therethrough.

The polishing table 3 is coupled to a table motor 5 via a table shaft 3*a*. The table motor 5 is configured to rotate the polishing table 3. The polishing table 3 is rotated around its axis by the table motor 5. The polishing pad 1 is rotated together with the polishing table 3. For example, the polishing table 3 is rotated in a direction indicated by arrow in FIG. 1.

The polishing head 10 is coupled to a polishing-head motor (not shown) via a polishing-head shaft 12. The polishing-head motor is configured to rotate the polishing head 10. The polishing head 10 is rotated about its axis by the polishing-head motor. The polishing head 10 is rotated together with the polishing-head shaft 12. For example, the polishing head 10 is rotated in a direction indicated by arrow in FIG. 1.

A lower surface of polishing head 10 is configured to hold the wafer W. A vacuum source (not shown) for attracting the wafer W via vacuum suction is coupled to the lower surface of the polishing head 10. The wafer W is held on the lower surface of the polishing head 10 by the vacuum suction created by the vacuum source. In other words, the lower surface of the polishing head 10 constitutes a wafer holding surface that holds the wafer W.

Furthermore, an airbag (not shown) is provided over the lower surface of the polishing head 10 for pressing the wafer W against the polishing surface 1*a* of the polishing pad 1. The airbag generates pressure to press the wafer W held by the polishing head 10. A gas supply line (not shown) is coupled to the airbag, and the pressure is adjusted according to an amount of gas supplied. The airbag presses the wafer W from its back side. The polishing head 10 presses the wafer W against the polishing surface 1*a* of the polishing pad 1 using the airbag.

The polishing head 10 is coupled to an elevating cylinder (not shown) via the polishing-head shaft 12. The elevating cylinder is configured to move the polishing head 10 in vertical directions (or move the polishing head 10 up and down). The polishing head 10 is moved up and down relative to the polishing pad 1 by the elevating cylinder. The polishing head 10 is moved up and down together with the polishing-head shaft 12. The elevating cylinder brings the surface of the wafer W (in other words, the surface to be polished) into contact with the polishing surface 1*a* of the polishing pad 1 by lowering the polishing head 10, holding the wafer W, toward the polishing pad 1. The elevating cylinder may further lower the polishing head 10 and press the surface of the wafer W against the polishing surface 1*a* of the polishing pad 1.

The dressing unit 20 includes a dresser 21, a dresser shaft 23 coupled to the dresser 21, a support block 25 that rotatably supports the dresser shaft 23, an air cylinder 26 for pressing the dresser 21 against the polishing pad 1, a dresser arm 27 that rotatably supports the dresser shaft 23, and a support shaft 28 that supports the dresser arm 27. A lower surface of the dresser 21 constitutes a dressing surface to which abrasive grains, such as diamond particles, are fixed. As will be described later, the dresser 21 comes into contact with the polishing surface 1*a* of the polishing pad 1.

The dresser 21 is coupled via the dresser shaft 23 to a dresser motor (not shown) installed within the dresser arm. The dresser motor is configured to rotate the dresser 21. The dresser 21 is rotated about its axis by the dresser motor. The dresser 21 rotates together with the dresser shaft 23. For example, the dresser 21 is rotated in a direction indicated by arrow in FIG. 1.

The dresser 21 is coupled to the support block 25 via the dresser shaft 23. The support block 25 is coupled to the air cylinder 26. The air cylinder 26 is configured to elevate and lower the dresser 21. The dresser 21 is moved up and down relative to the polishing pad 1 by the air cylinder 26. The air cylinder 26 moves up and down the dresser shaft 23 and the support block 25 together. The air cylinder 26 presses the dressing surface of the dresser 21 against the polishing surface 1*a* of the polishing pad 1 by lowering the dresser 21 toward the polishing pad 1.

The support shaft 28 is coupled to a motor (not shown), and this motor is configured to rotate the support shaft 28. The support shaft 28 is rotated around its axis by the motor. The dresser 21, the dresser shaft 23, and the dresser arm 27 swing together around the support shaft 28 due to the rotation of the support shaft 28.

The controller 50 includes at least one computer. The controller 50 includes a memory 50*a* that stores programs therein, and an arithmetic device 50*b* configured to execute arithmetic operations according to instructions included in the programs. The memory 50*a* includes a main memory, such as a RAM, and an auxiliary memory, such as a hard disk drive (HDD) or a solid state drive (SSD). Examples of the arithmetic device 50*b* include a CPU (central processing unit) and a GPU (graphic processing unit). However, the specific configuration of the controller 50 is not limited to these examples.

Polishing of the wafer W is performed as follows. The polishing head 10 holds the wafer W with its front surface (the surface to be polished) facing the polishing pad 1. While the polishing table 3 is rotated by the table motor 5, the polishing liquid is supplied onto the polishing surface 1*a* of the polishing pad 1 from the polishing-liquid supply nozzle 10. In this state, the polishing head 10 is rotated by the polishing-head motor and lowered by the polishing-head elevating mechanism. As a result, the surface of the wafer W comes into contact with the polishing surface 1*a* of the polishing pad 1. Furthermore, the polishing head 10 presses the wafer W against the polishing pad 1. The surface of the wafer W is polished by a chemical action of the polishing liquid and mechanical actions of the abrasive grains contained in the polishing liquid and the polishing surface 1*a*.

Dressing of the polishing surface 1*a* of the polishing pad 1 is performed as follows. While the polishing table 3 is rotated by the table motor 5, pure water is supplied onto the polishing surface 1*a* of the polishing pad 1 from a pure-water supply nozzle (not shown). In this state, the dresser 21 is lowered by the air cylinder 26 while the dresser 21 is rotated by the dresser motor. As a result, the dressing surface of the dresser 21 comes into contact with the polishing surface 1*a* of the polishing pad 1. The dressing surface of the dresser 21 is pressed against the polishing surface 1*a* of the polishing pad 1 by the air cylinder 26. Furthermore, the dresser 21 oscillates on the polishing surface 1*a* in parallel with the polishing surface 1*a* of the polishing pad 1. In this way, the polishing pad 1 is scraped off by the dresser 21, and the polishing surface 1*a* is dressed (regenerated). In other words, the polishing performance of the polishing pad 1 is restored by the dressing. Dressing of the polishing surface 1*a* of the polishing pad 1 is performed during or after polishing of the wafer W.

The optical film-thickness measuring device 30 includes a light source 31, an optical sensor head 35 disposed inside the polishing table 3, and a spectrometer 37. The light source 31, the optical sensor head 35, and the spectrometer 37 are attached to the polishing table 3 and rotate together with the polishing table 3 and the polishing pad 1. The optical sensor head 35 is optically coupled to the light source 31 and the spectrometer 37. The light source 31 and the spectrometer 37 are coupled to the controller 50.

The optical sensor head 35 includes a light-emitting element 32 and a light-receiving element 33. For example, the light-emitting element 32 and the light-receiving element 33 are each configured with an optical fiber cable. The light-emitting element 32 may be referred to as light-emitting optical fiber 32, and the light-receiving element 33 may be referred to as light-receiving optical fiber 33. An end (distal end) of the light-emitting element 32 and an end (distal end) of the light-receiving element 33 are directed upward and face the wafer W to be polished as described below. The end of the light-emitting element 32 and the end of the light-receiving element 33 are inclined in a direction toward each other. The other end of the light-emitting element 32 is optically coupled to the light source 31, and the other end of the light-receiving element 34 is optically coupled to the spectrometer 37.

Examples of the light source 31 include a light emitting diode (LED), a halogen lamp, and a xenon lamp. The optical sensor head 35 directs the light from the light source 31 onto the surface of the wafer W, and receives the light reflected off the surface of the wafer W. Specifically, the light-emitting element 32 transmits the light from the light source 31 and casts the light on the surface of the wafer W. The light-receiving element 33 receives the reflected light from the surface of the wafer W. The spectrometer 37 generates a spectrum by decomposing the reflected light, received by the light-receiving element 33, according to wavelengths of the reflected light and measuring an intensity of the reflected light at each of the wavelengths. The controller 50 determines a film thickness of wafer W based on the spectrum. As a result, a measured value of the film thickness is obtained. The controller 50 determines that the polishing end point has been reached when the measured value of the film thickness reaches a predetermined target value.

The optical sensor head 35 is disposed inside the hole 7 of the polishing table 3. The optical sensor head 35 is located below the polishing surface 1*a* of the polishing pad 1. In other words, the end of the light-emitting element 32 and the end of the light-receiving element 33 are located lower than the polishing surface 1*a* of the polishing pad 1. As shown in FIG. 1, the end of the light-emitting element 32 and the end of the light-receiving element 33 are arranged below the upper surface of the polishing table 3. The end of the light-emitting element 32 and the end of the light-receiving element 33 may be arranged inside the through-hole 1*b* as long as they are located below the polishing surface 1*a* of the polishing pad 1.

The through-hole 1*b* and the hole 7 are filled with a liquid (e.g., pure water) as a medium that allows the light to transmit therethrough. In other words, a space between the surface of the wafer W to be polished and the optical sensor head 35 (in particular, the end of the light-emitting element 32 and the end of the light-receiving element 33) is filled with the liquid. Therefore, the incident light from the light-emitting element 32 toward the surface of the wafer W and the reflected light from the surface of the wafer W to the light-receiving element 33 pass through the liquid. This liquid is supplied by a liquid supply line (not shown) coupled to the hole 7 and discharged through a liquid discharge line (not shown) coupled to the hole 7.

The medium that transmits the light may be air, instead of the liquid. A transparent window (not shown) may be provided instead of the liquid that transmits the light. The transparent window may be provided inside the through-hole 1*b* or may be provided inside the hole 7, as long as the transparent window is located below the polishing surface 1*a* of the polishing pad 1 and above the optical sensor head 35 (the ends of the light-emitting element 32 and the light-receiving element 33). In this arrangement, the transparent window is provided so as to close at least one of the through-hole 1*b* and the hole 7.

Figure 2:
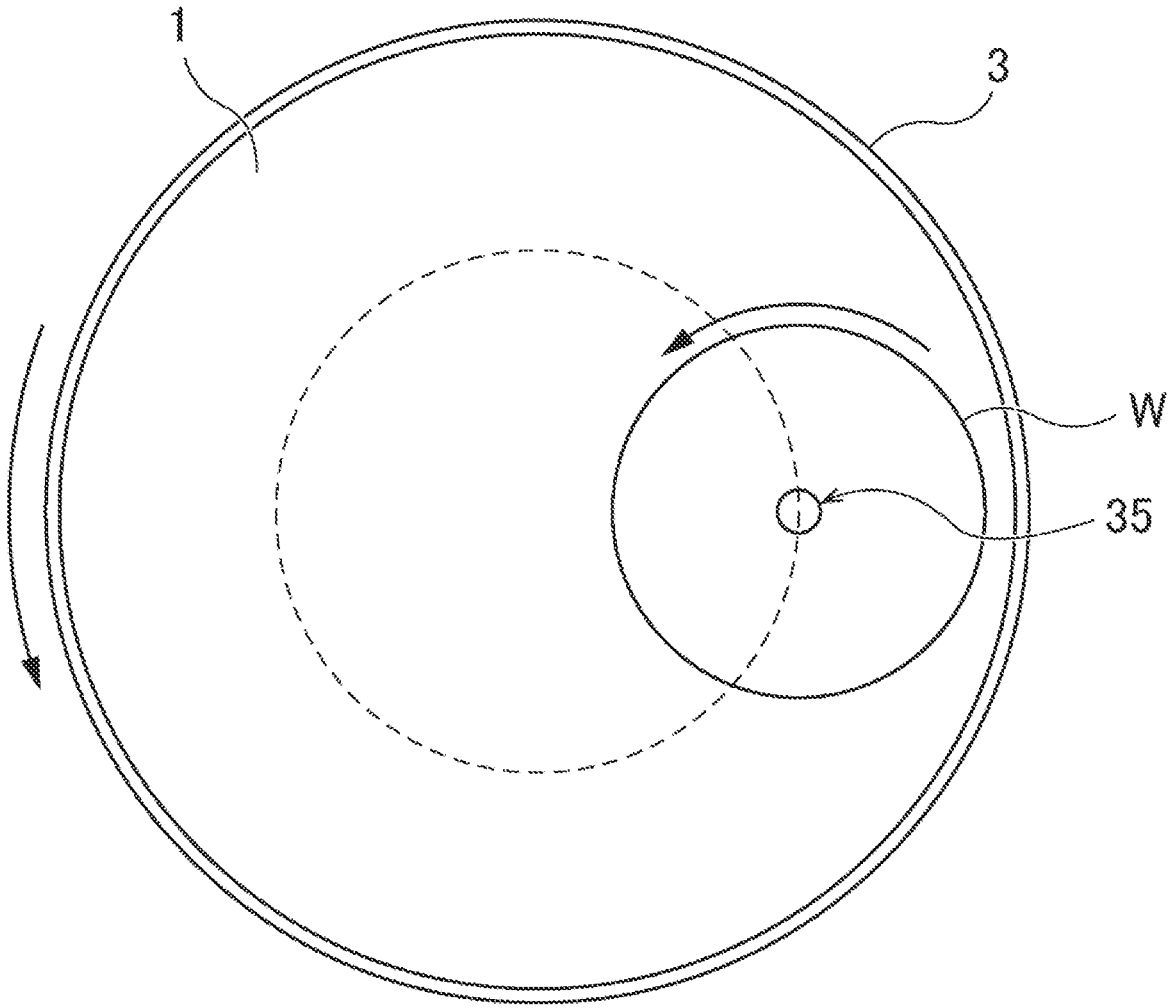
FIG. 2 is a top view showing a positional relationship between a wafer being polished and a polishing table.

FIG. 2 is a top view showing a positional relationship between the wafer W and the polishing table 3 during polishing of the wafer W. The optical sensor head 35 traverses (in other words, passes across) the wafer W in a trajectory shown by a dotted line in FIG. 2 each time the polishing table 3 makes one rotation. The optical sensor head 35 is arranged at a predetermined distance from the center of the polishing table 3 in a radial direction of the polishing table 3. The center of the wafer W is arranged at a predetermined distance from the center of the polishing table 3 in the radial direction of the polishing table 3. In FIG. 2, the distance from the center of the polishing table 3 to the optical sensor head 35 is equal to the distance from the center of the polishing table 3 to the center of the wafer W. Therefore, in FIG. 2, the optical sensor head 35 moves across the center of the wafer W as the polishing table 3 rotates.

It should be noted that FIG. 2 shows an example in which the optical sensor head 35 moves across the center of the wafer W, and the arrangement of the optical sensor head 35 is not limited to this example, as long as the optical sensor head 35 moves under the wafer W.

While moving under the wafer W, the optical sensor head 35 intermittently irradiates the surface of the wafer W with the light at predetermined time intervals. Specifically, the controller 50 controls the light source 31 and instructs the light source 31 to emit the light intermittently at predetermined time intervals. The light emitted by the light source 31 is intermittently directed to the surface of the wafer W through the light-emitting element 32 at predetermined time intervals. As a result, the multiple locations on the surface of the wafer W are irradiated with the light, and the film thickness at each of the locations is measured.

When the optical sensor head 35 is moving under the wafer W, the optical sensor head 35 may maintain the light irradiation of the surface of the wafer W so as to measure the film thickness. In other words, the optical sensor head 35 may continuously irradiate the surface of the wafer W with the light. In this case, the controller 50 controls the light source 31 and instructs the light source 31 to keep emitting the light while the optical sensor head 35 is moving under the wafer W. The light emitted by the light source 31 is continuously directed to the surface of the wafer W through the light-emitting element 32. The spectrometer 12 generates spectra at predetermined time intervals. As a result, the film thickness at each location can be measured by analyzing the spectra obtained at the predetermined time intervals.

Hereinafter, the location on the surface of the wafer W that is irradiated with the light will be referred to as "measurement point." The time intervals at which the film thickness is measured is referred to as "measurement intervals." In particular, when the optical sensor head 35 intermittently irradiates the wafer with the light, the time intervals of the light irradiation are referred to as measurement intervals. When the optical sensor head continuously irradiates the wafer with the light, predetermined time intervals at which the spectrometer 37 generates the spectra are referred to as measurement intervals.

The controller 50 associates the measured values of the film thickness at the measurement points with measurement coordinates indicating the positions of the measurement points. The measurement coordinates are coordinates (position coordinates) indicating the positions on the surface of the wafer W. For example, the measurement coordinates are indicative of radial positions on the wafer W. Each time the optical sensor head 35 moves across the wafer W, the controller 50 associates the measured value of the film thickness at each measurement point with the measurement coordinates. In this way, a film-thickness distribution is generated based on the measured values of the film thickness and the measurement coordinates at multiple measurement points. For example, the film-thickness distribution is generated by the controller 50.

The film-thickness distribution is a distribution of the measured values of the film thickness at the corresponding measurement coordinates. The measured value of the film thickness at each measurement coordinates may be expressed as an average of measured values of the film thickness at each measurement coordinates. For example, the measurement coordinates can be expressed as a position in the diameter of the wafer W. In this case, the film-thickness distribution can be expressed as a film-thickness distribution in the diameter of the wafer W. For example, the measurement coordinates can be expressed as a position in the radius of the wafer W. In this case, the film-thickness distribution can be expressed as a film-thickness distribution in the radius of the wafer W.

In one example, the measurement coordinates are determined as follows. The controller 50 is coupled to the table motor 5. The controller 50 receives information on the rotation of the polishing table 3 from the table motor 5. The controller 50 determines that the optical sensor head 35 is moving under the wafer W when the polishing table 3 is within a predetermined range of rotation angle. Based on the determination, the controller 50 instructs the optical film-thickness measuring device 30 to measure the film thickness at predetermined measurement intervals. Further, based on the determination, the controller 50 detects the rotational speed (or angular speed) of the polishing table 3 during the measuring of the film thickness. The controller 50 determines the rotation angle at a predetermined time based on the detected rotational speed. The controller 50 determines the position of the optical sensor head 35 at the predetermined time based on the rotation angle. Furthermore, the controller 50 determines the position of the measurement point, i.e., the measurement coordinates, based on the determined position of the optical sensor head 35 and the measurement intervals. In this way, the controller 50 associates the measurement coordinates with the measured value of the film thickness at each measurement point.

The predetermined range of the rotation angle for determining that the optical sensor head 35 is moving under the wafer W can be set in advance based on the position and size of the wafer W. The measurement coordinates may be determined by a method other than the above-discussed method.

Figure 3:
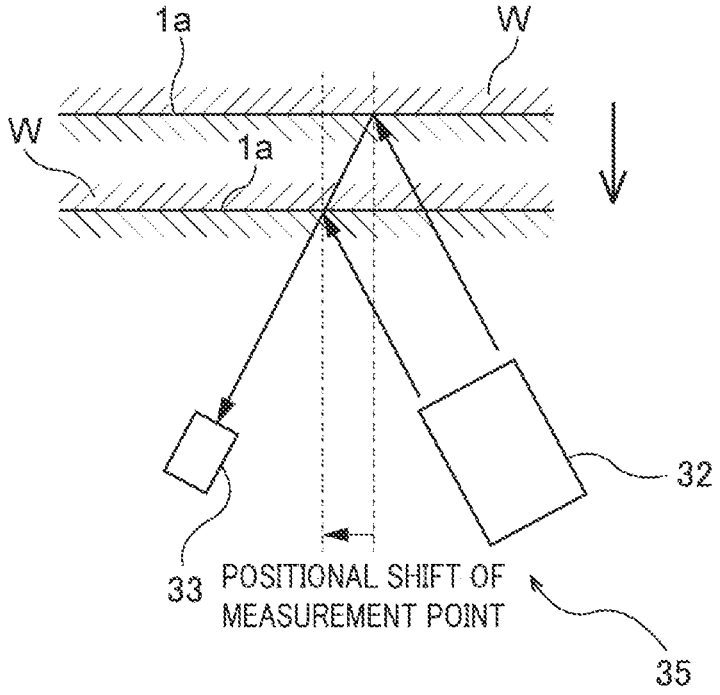
FIG. 3 is an enlarged view showing a path of light from a light-emitting optical fiber (or a light-emitting element) to a light-receiving optical fiber (or a light-receiving element)

FIG. 3 is an enlarged view showing a path of the light from the light-emitting optical fiber (light-emitting element) 32 to the light-receiving optical fiber (light-receiving element) 33. As shown in FIG. 3, the distal end of the light-emitting optical fiber 32 and the distal end of the light-receiving optical fiber 33 are inclined at predetermined angle with respect to the surface of the wafer W. The incident angle is an angle between a line normal to the wafer W and the incident light at a point where the light is incident on the wafer W, i.e., at the measurement point. A reflection angle is an angle between the line normal to the wafer W and the reflected light at the measurement point.

The wafer W may have a multilayered structure in which films and interconnects of various materials are stacked. The multilayered structure may exist from the inside to the surface of the wafer W. When such wafer W is irradiated with the light from a direction perpendicular to the wafer W during measuring of the film thickness, the light may pass through a film of an uppermost layer of the wafer W (i.e., a layer constituting the surface of the wafer W). As a result, the incident light is reflected off inner layers deeper than the uppermost layer. In this case, the spectrum obtained includes not only information on the uppermost layer of the wafer W, but also information on the inner layers of the wafer W through which the light has passed. As a result, when the surface of the wafer W is irradiated with the light from a direction perpendicular to the surface of the wafer W for measuring the film thickness, it may be difficult to obtain an accurate measured value of the film thickness of the uppermost layer of the wafer W.

In order to obtain a more accurate measured value of the film thickness of the uppermost layer of the wafer W, the light-emitting optical fiber 32 may be inclined as described above.

The distal end of the light-receiving optical fiber 33 is inclined at an angle that allows the light-receiving optical fiber 33 to receive the reflected light. However, it is preferable that the light-receiving optical fiber 33 receives the light at an angle substantially equal to the angle of reflection of the light on the surface of the wafer W. Specifically, it is preferable that the distal end of the light-receiving optical fiber 33 is inclined such that the reflected light enters the distal end of the light-receiving optical fiber 33 substantially perpendicularly. In this case, as shown in FIG. 3, the distal end of the light-emitting optical fiber 32 and the distal end of the light-receiving optical fiber 33 are inclined toward each other at the same angle.

The thickness of the polishing pad 1 gradually decreases due to wear as a result of polishing of the wafer W and dressing of the polishing surface 1*a*. In other words, the thickness of polishing pad 1 gradually decreases. As the thickness of the polishing pad 1 decreases, the surface of the wafer W when pressed against the polishing pad 1 approaches the light-emitting optical fiber 32 and the light-receiving optical fiber 33 (i.e., the optical sensor head 35). As described above, the light-emitting optical fiber 32 emits the light to the wafer W in an oblique incident angle. Therefore, when the light path between the light-emitting optical fiber 32 and the measurement point becomes shorter, the position of the measurement point is shifted in an in-plane direction of the wafer W, as shown in FIG. 3. Specifically, the position of the measurement point after the thickness of the polishing pad 1 has decreased is different from that before the thickness of the polishing pad 1 decreases. As a result, the path of the reflected light changes due to the positional shift of the measurement point, and the light-receiving optical fiber 33 may not be able to receive the reflected light.

Therefore, in order to enable the light-receiving optical fiber 33 to receive the reflected light even if the position of the measurement point is shifted, the distal end of the light-emitting optical fiber 32 has a diameter large enough to allow the positional shift of the measurement point. For example, as shown in FIG. 3, a diameter of the light-emitting optical fiber 32 is larger than a diameter of the light-receiving optical fiber 33. With these configurations, even if the position of the measurement point is shifted as the thickness of the polishing pad 1 decreases, the light-receiving optical fiber 33 can receive the reflected light.

Although not shown, the distal end of the light-receiving optical fiber 33 may have a diameter large enough to allow the positional shift of the measurement point. In this case, the diameter of the light-receiving optical fiber 33 is larger than the diameter of the light-emitting optical fiber 32. In this case also, the light-receiving optical fiber 33 can receive the reflected light even if the position of the measurement point is shifted.

Figure 4:
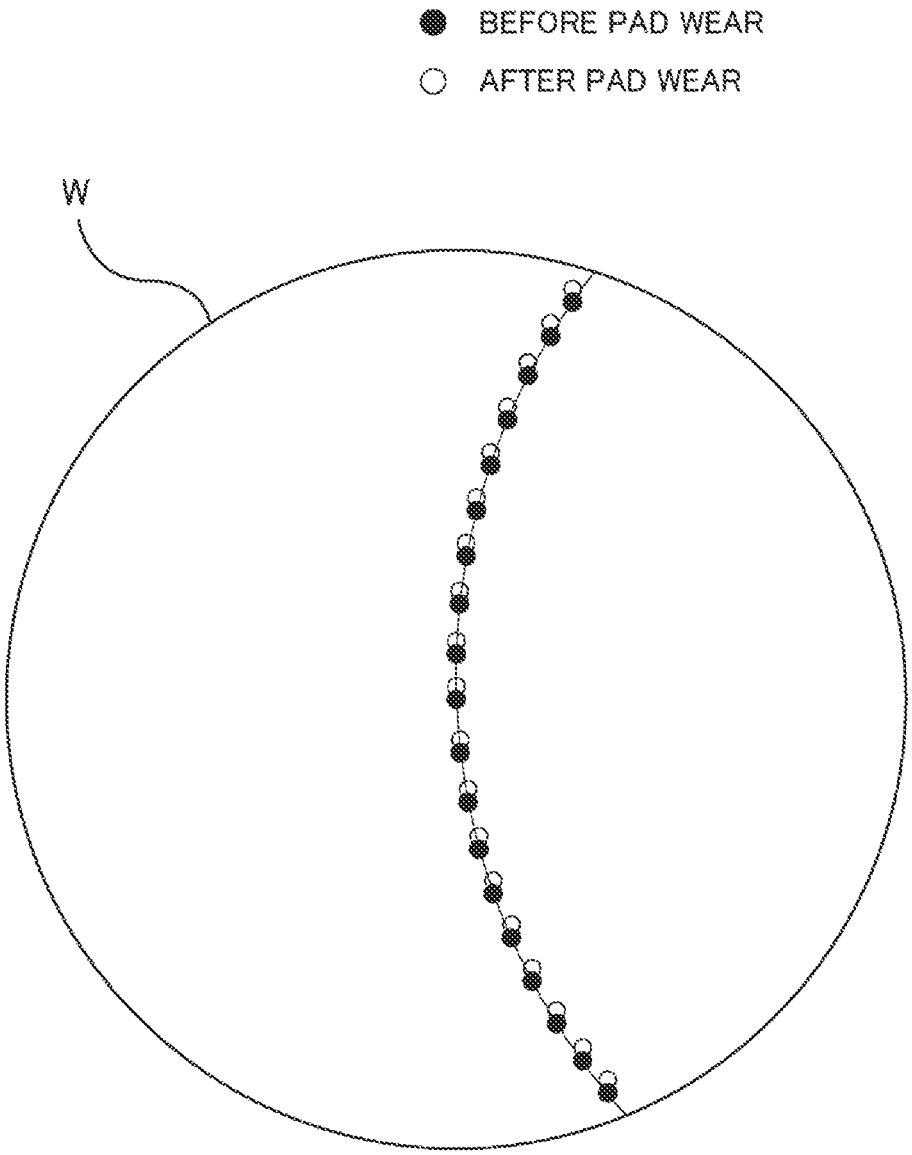
FIG. 4 shows an example of multiple measurement points on the surface of the wafer W.

FIG. 4 is a diagram showing an example of multiple measurement points on the surface of the wafer W. FIG. 4 shows multiple measurement points before the thickness of the polishing pad 1 decreases (before the polishing pad 1 is worn out) and multiple measurement points after the thickness of the polishing pad 1 has decreased (after the polishing pad 1 is worn out). As shown in FIG. 4, when the thickness of the polishing pad 1 decreases, the positional shift occurs at each measurement point. As a result, when the film thickness is measured under the same measurement conditions before and after the thickness of the polishing pad 1 decreases, different locations on the surface of the wafer W will be measured. If the positional shift of the measurement points is not reflected in the measurement coordinates, the measurement coordinates associated with the measured values of the film thickness will indicate different positions from the actual measurement coordinates.

Figure 5:
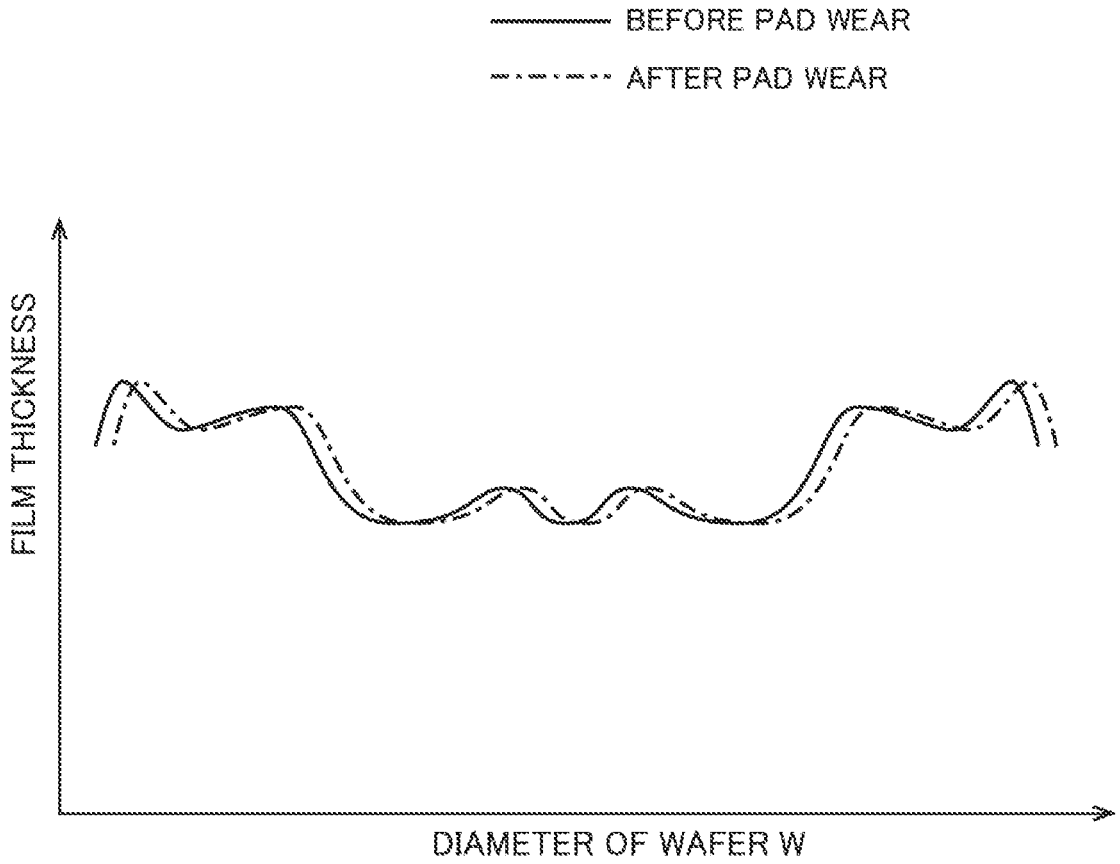
FIG. 5 is a diagram showing an example of film-thickness distribution.

FIG. 5 is a diagram showing film-thickness distribution. FIG. 5 shows an example of the film-thickness distribution in the diameter of the wafer W. The film-thickness distribution shown by a solid line is a film-thickness distribution generated based on multiple measurement points before the thickness of the polishing pad 1 shown in FIG. 4 decreases (before the polishing pad 1 is worn out). The film-thickness distribution shown by a dashed line is a film-thickness distribution generated based on multiple measurement points after the thickness of the polishing pad 1 shown in FIG. 4 has decreased (after the polishing pad 1 has been worn out). As discussed above, in the film-thickness distribution after the thickness of the polishing pad 1 has decreased, the measurement coordinates associated with the measured values of the film thickness indicate different positions from the actual positions. As a result, as shown in FIG. 5, the film-thickness distribution is shifted as a whole.

Therefore, in this embodiment, the measurement coordinates are corrected based on first correlation data indicating a relationship between the thickness of the polishing pad 1 and amount of movement of the measurement point(s). The amount of movement of the measurement point means a distance of movement of a measurement point in the in-plane direction of the wafer W from an initial position of that measurement point. Specifically, the amount of movement of the measurement point(s) indicates a degree of positional shift of the measurement point(s) described above. For example, the first correlation data is stored in the memory 50*a* of the controller 50. The first correlation data is determined in advance through experiment.

Specifically, the first correlation data includes a reference value for the thickness of polishing pad 1. This reference value is associated with the amount of movement of the measurement point as zero. Specifically, the reference value of the thickness of the polishing pad 1 is associated with a value indicating the initial position of the measurement point. The first correlation data indicates the amount of movement of the measurement point when the thickness of the polishing pad 1 changes relative to the reference value of the thickness of the polishing pad 1. Each value indicating the thickness of the polishing pad 1 is associated with the amount of movement of the measurement point.

When the thickness of polishing pad 1 changes, a height of the polishing surface 1*a* also changes. Therefore, the first correlation data may be defined by the height of the polishing surface 1*a* instead of the thickness of the polishing pad 1. Specifically, the first correlation data may be expressed as a relationship between the height of the polishing surface 1*a* and the amount of movement of the measurement point(s). In this case, the first correlation data indicates the amount of movement of the measurement point when the height of the polishing surface 1*a* changes relative to a reference value of the height of the polishing surface 1*a*. Each value indicating the height of the polishing surface 1*a* is associated with the amount of movement of the measurement point.

The arithmetic device 50*b* of the controller 50 determines the amount of movement of the measurement point from the measured value of the thickness of the polishing pad 1 based on the first correlation data by executing arithmetic operation according to the instructions included in the program. The arithmetic device 50*b* of the controller 50 corrects the measurement coordinates based on the determined amount of movement of the measurement point. The measuring of the thickness of the polishing pad 1 will be described below.

The following descriptions refers to FIG. 1 again. The polishing apparatus can measure the thickness of the polishing pad 1 using the dressing unit 20. The dressing unit includes a first pad-thickness measuring device 29 configured to measure the thickness of the polishing pad 1. The first pad-thickness measuring device 29 is, for example, a contact displacement sensor. The first pad-thickness measuring device 29 is fixed to the support block 25. The first pad-thickness measuring device 29 has a contact element that is in contact with the dresser arm 27. Since the support block 25 can move up and down together with the dresser shaft 23 and the dresser 21, the first pad-thickness measuring device 29 can move up and down together with the dresser shaft 23 and the dresser 21. On the other hand, the vertical position of the dresser arm 27 is fixed. While the contact element of the first pad-thickness measuring device 29 keeps in contact with the dresser arm 27, the first pad-thickness measuring device 29 moves up and down together with the dresser shaft 23 and the dresser 21. Therefore, the first pad-thickness measuring device 29 can measure a displacement of the dresser 21 with respect to the dresser arm 27.

The first pad-thickness measuring device 29 can measure the thickness of the polishing pad 1 via the dresser 21. Specifically, the first pad-thickness measuring device 29 can measure the thickness of the polishing pad 1 by measuring the height of the polishing surface 1*a* from the lower surface of the polishing pad 1 as a reference surface. Since the first pad-thickness measuring device 29 is coupled to the dresser 21 via the dresser shaft 23, the first pad-thickness measuring device 29 can measure the thickness of the polishing pad 1 while the dresser 21 is dressing the polishing pad 1. Furthermore, the first pad-thickness measuring device 29 can measure the thickness of the polishing pad 1 when the rotation of the polishing table 3 and the rotation of the dresser 21 are stopped and the dressing is stopped.

The first pad-thickness measuring device 29 may be a non-contact sensor, such as a laser sensor, an ultrasonic sensor, or an eddy current sensor. Furthermore, the first pad-thickness measuring device 29 may be fixed to the dresser arm 27 and may be arranged to measure a displacement of the support block 25. With this configuration also, the first pad-thickness measuring device 29 can measure the displacement of the dresser 21 with respect to the dresser arm 27.

The first pad-thickness measuring device 29 can also measure a distance from a preset reference plane to the polishing surface 1*a* as the height of the polishing surface 1*a*. The reference plane may be a virtual plane. The first correlation data may be defined based on the relationship between the height of the polishing surface 1*a* measured in this manner and the amount of movement of the measurement point.

The first pad-thickness measuring device 29 is electrically coupled to the controller 50. The controller 50 receives output signal of the first pad-thickness measuring device 29. Specifically, the controller 50 can receive a measured value of the thickness of the polishing pad 1 measured by the first pad-thickness measuring device 29. Furthermore, as described above, when the first pad-thickness measuring device 29 measures the height of the polishing surface 1*a*, the controller 50 can receive a measured value of the height of the polishing surface 1*a*.

In one embodiment, the same mechanism as the pad-height measuring device described above may be provided near the polishing head 10 so as to measure the height of the polishing surface 1*a* and the thickness of the polishing pad 1 via the polishing head 10.

Figure 6:
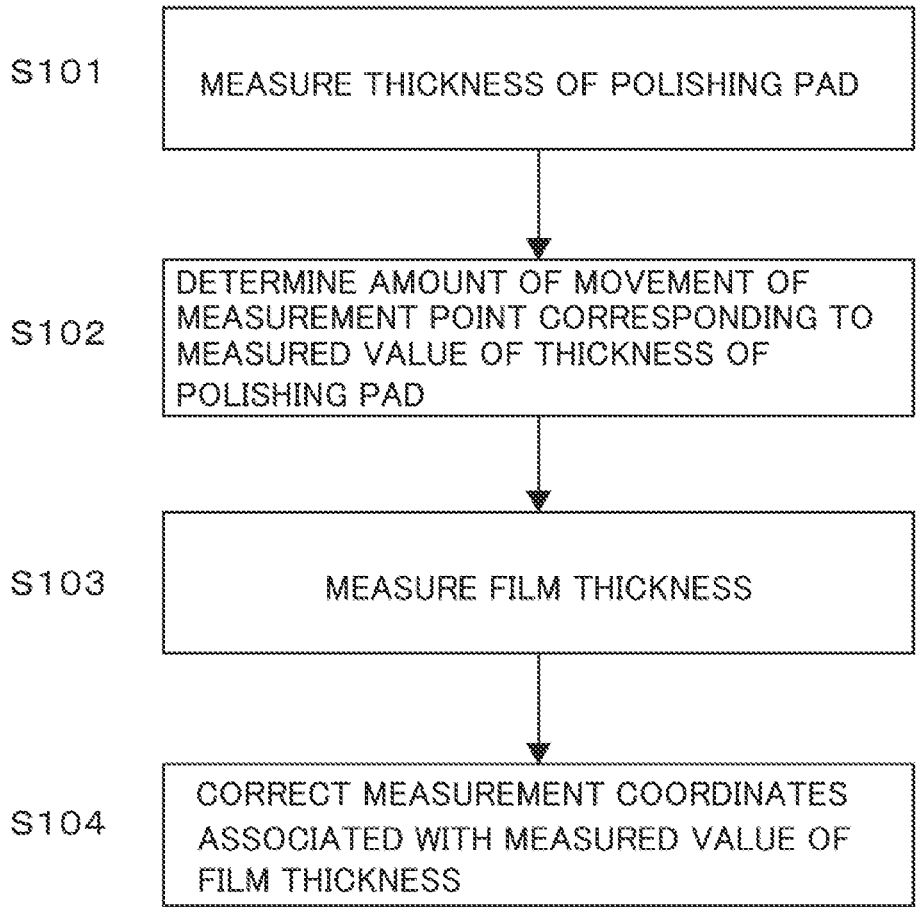
FIG. 6 is a flowchart showing operations of the polishing apparatus of the first embodiment.

FIG. 6 is a flowchart showing operations of the polishing apparatus shown in FIG. 1. In step S101, the thickness of the polishing pad 1 is measured by the pad-height measuring device of the dressing unit 20. Next, in step S102, the controller 50 determines the amount of movement of the measurement point corresponding to the thickness of the polishing pad 1 based on the first correlation data. Next, in step S103, the optical film-thickness measuring device 30 measures the film thickness, and the measurement coordinates are associated with the measured value of the film thickness. Next, in step S104, the controller 50 corrects the measurement coordinates associated with the measured value of the film thickness by the amount of movement of the measurement point determined in the step S102. As a result, the measurement coordinates associated with the measured value of the film thickness indicate a more accurate position. Furthermore, the correcting of the measurement coordinates can make it possible to prevent the entire film-thickness distribution from shifting as shown in FIG. 5.

Although the step S101 and the step S102 are executed before the step S103 in FIG. 6, these steps may be executed simultaneously with the step S103. The step S101 and the step 102 may be performed after the step S103.

Figure 7:
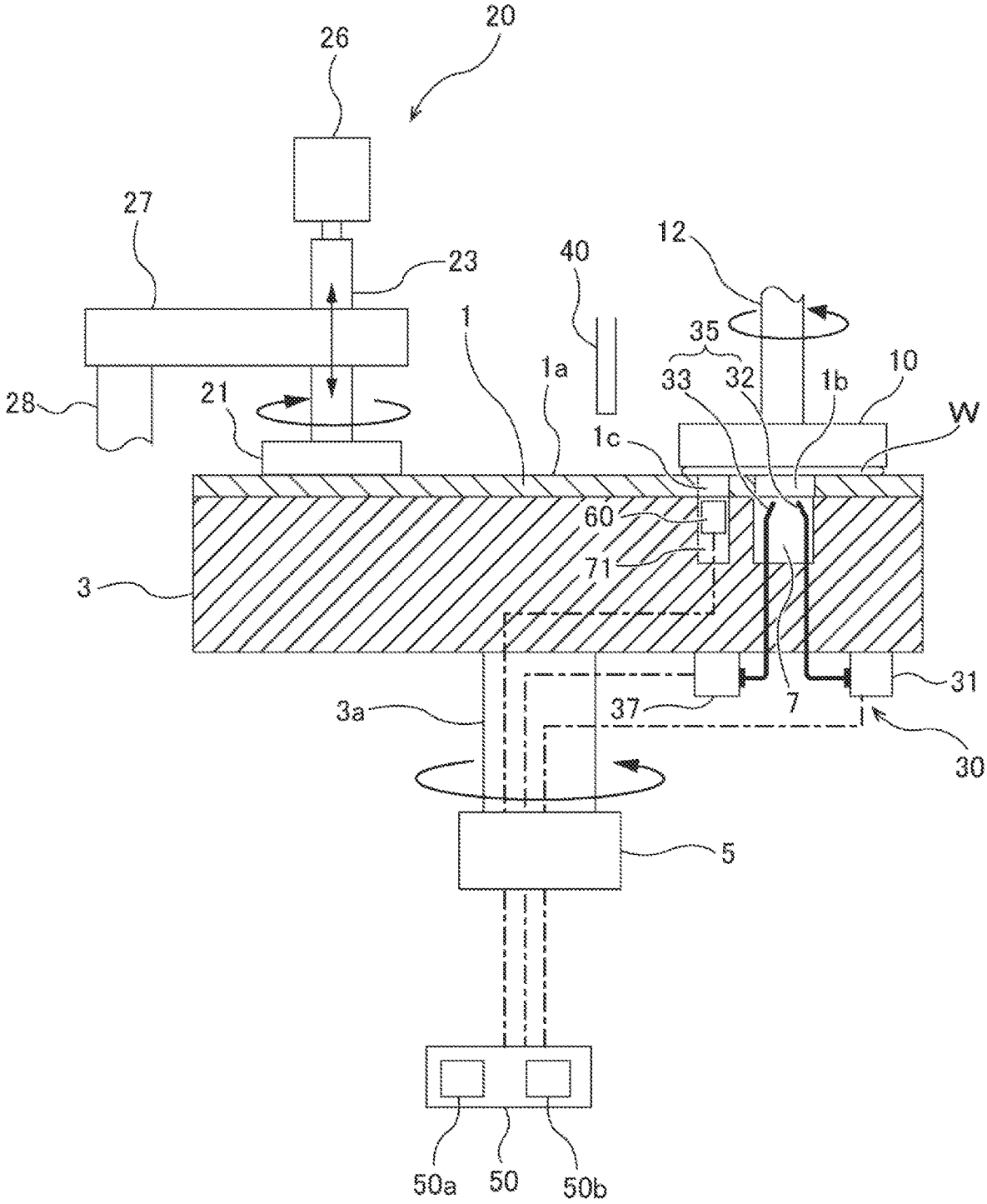
FIG. 7 is a diagram showing a modification of the polishing apparatus of the first embodiment.

The thickness of the polishing pad 1 and the height of the polishing surface 1*a* can be measured using the polishing apparatus shown in FIG. 7. FIG. 7 shows a modification of the polishing apparatus of the embodiment. Unless otherwise mentioned, the polishing apparatus in FIG. 7 has the same configurations as those of the polishing apparatus in FIG. 1, and therefore, redundant explanations will be omitted. The modification of the polishing apparatus will be explained below with reference to FIG. 7.

The polishing apparatus includes a second pad-thickness measuring device 60. The polishing pad 1 has a through-hole 1*c* formed therein. A hole 71 is formed in the upper surface of the polishing table 3. The through-hole 1*c* and the hole 71 are in communication. As will be described later, the through-hole 1*c* allows the light to pass therethrough for measuring the thickness of the polishing pad 1. The second pad-thickness measuring device 60 is arranged in the polishing table 3. Specifically, the second pad-thickness measuring device 60 is placed inside the hole 71 and is disposed below the upper surface of the polishing table 3.

In FIG. 7, the dressing unit 20 does not include the support block 25 and the first pad-thickness measuring device 29, but may include these configurations.

The second pad-thickness measuring device 60 is, for example, an optical distance measuring sensor. The second pad-thickness measuring device 60 measures the thickness of the polishing pad 1 by emitting light when the top of the second pad-thickness measuring device 60 is covered with the wafer W placed on the polishing pad 1 and receiving reflected light from the wafer W. During measurement, the surface of the wafer W can be regarded as substantially the same height as the polishing surface 1*a*. The second pad-thickness measuring device 60 can measure the thickness of the polishing pad 1 during polishing of the wafer W.

As well as the first pad-thickness measuring device 29 described above, the second pad-thickness measuring device 60 can measure the thickness of the polishing pad 1 by measuring the height of the polishing surface 1*a* (technically, the surface of the wafer W) from the lower surface of the polishing pad 1 as a reference plane.

The second pad-thickness measuring device 60 can also measure a distance from a preset reference plane to the polishing surface 1*a* as the height of the polishing surface 1*a*. The reference plane may be a virtual plane. The first correlation data may be defined based on the relationship between the height of the polishing surface 1*a* measured in this manner and the amount of movement of the measurement point.

The second pad-thickness measuring device 60 is electrically coupled to the controller 50. The controller 50 receives output signal of the second pad-thickness measuring device 60. Specifically, the controller 50 can receive a measured value of the thickness of the polishing pad 1 measured by the second pad-thickness measuring device 60. Furthermore, as described above, when the second pad-thickness measuring device 60 measures the height of the polishing surface 1*a*, the controller 50 can receive a measured value of the height of the polishing surface 1*a*.

Each step described with reference to FIG. 6 can be performed by the polishing apparatus shown in FIG. 7 as well. In particular, the step S101 in FIG. 6 can be performed using the second pad-thickness measuring device.

When the optical sensor head 35 is moving under the wafer W while measuring the film thickness, the polishing pad 1 above the optical sensor head 35 is temporarily compressed by the load from the polishing head 10. As a result, the optical sensor head 35 is temporarily approaching the surface of the wafer W. In order to measure the thickness of the polishing pad 1 including the influence of the pressing load near the optical sensor head 35, the second pad-thickness measuring device 60 may be disposed at a position where the second pad-thickness measuring device 60 and the optical sensor head 35 are covered by the wafer W at the same time.

According to the present embodiment, even if the measurement point moves from its initial position due to the change in the thickness of the polishing pad 1, the measurement coordinates associated with the measured value of the film thickness indicate the accurate position. In other words, the accuracy of the position coordinates associated with the measured value of the film thickness can be improved. In particular, when the light for measuring the film thickness is obliquely incident on the surface of the wafer W, the measurement point is shifted in the in-plane direction of the wafer W due to the change in the thickness of the polishing pad 1. In this embodiment, the thickness of the polishing pad 1 is measured, and the amount of movement of the measurement points (i.e., the distance by which the measurement points have been shifted) is determined based on the relationship (first correlation data) between the thickness of the polishing pad 1 and the amount of movement of the measurement point. By correcting the measurement coordinates based on the amount of movement of the measurement point determined in this way, the measurement coordinates associated with the measured value of the film thickness can indicate the accurate position even if the thickness of the polishing pad 1 has changed.

According to the present embodiment, the light is emitted from the light-emitting optical fiber 32 inclined with respect to the surface of the wafer W. This makes it possible to suppress information on the inside of the wafer W contained in the spectrum while emphasizing information on the film of the uppermost layer of the wafer W.

According to this embodiment, even if the measurement point moves due to the change in the thickness of the polishing pad 1, the light-receiving optical fiber 33 can receive the reflected light from the measurement point. Specifically, the diameter of one of the light-emitting optical fiber 32 and the light-receiving optical fiber 33 is larger than the diameter of the other. This configuration makes it possible to cope with the change in the light path due to movement of the measurement point.

Second Embodiment

In the first embodiment discussed above, the thickness of the polishing pad 1 is measured in order to determine the amount of movement of the measurement point. In this embodiment, the amount of movement of the measurement point is determined without measuring the thickness of the polishing pad 1. Configurations and operations of this embodiment, which are not particularly described, are the same as those of the first embodiment described with reference to FIGS. 1 to 7, and redundant explanations will be omitted. Note that this embodiment can be performed by either the polishing apparatus shown in FIG. 1 or the polishing apparatus shown in FIG. 7.

As described in the first embodiment, when the thickness of polishing pad 1 decreases, the light path between the optical sensor head 35 and the surface of wafer W becomes shorter. Specifically, the path of light from the light-emitting optical fiber 32 to the measurement point becomes shorter (see FIG. 3). Furthermore, the path of light from the measurement point to the light-receiving optical fiber 33 also becomes shorter. As a result, as the thickness of the polishing pad 1 changes, a quantity of light received by the light-receiving optical fiber 33 (i.e., a quantity of received light) also changes.

Therefore, in the present embodiment, the controller 50 determines the thickness of polishing pad 1 from the quantity of received light, based on a relationship between the thickness of polishing pad 1 and the quantity of received light. Furthermore, the controller 50 determines the amount of movement of the measurement point(s) from the thickness of the polishing pad 1 based on the first correlation data described in the first embodiment, and corrects the measurement coordinates associated with the measured value of the film thickness.

In the present embodiment, the controller 50 measures (determines) the quantity of light received by the light-receiving optical fiber (light-receiving element), i.e., the quantity of received light. For example, the controller 50 may measure the quantity of received light based on the spectrum obtained from the spectrometer 37.

Figure 8:
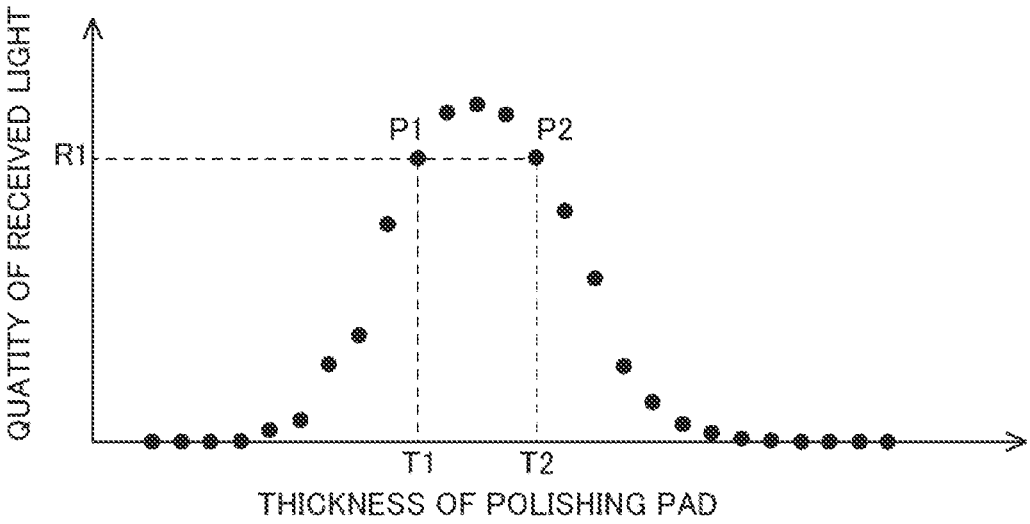
FIG. 8 is a diagram showing a relationship between thickness of a polishing pad and quantity of received light in a second embodiment.

FIG. 8 is a diagram showing the second correlation data in this embodiment. The second correlation data indicates the relationship between the thickness of the polishing pad 1 and the quantity of received light. For example, the second correlation data is stored in the memory 50*a* of the controller 50. The second correlation data is determined in advance through experiment.

The arithmetic device 50*b* of the controller 50 determines the thickness of the polishing pad 1 from a measured value of the quantity of received light based on the second correlation data by executing arithmetic operation according to instructions included in the program. After the thickness of the polishing pad 1 is determined, the same processes as in the first embodiment are performed. Specifically, the arithmetic device 50*b* of the controller 50 determines the amount of movement of the measurement point from the thickness of the polishing pad 1 based on the first correlation data, and corrects the measurement coordinates based on the amount of movement of the measurement point. As shown in FIG. 8, the relationship between the thickness of the polishing pad 1 and the quantity of received light is a normal distribution.

As shown in FIG. 8, the distribution of the quantity of received light corresponding to the thickness of the polishing pad 1 may exhibit a gradient. In this case, the thickness of the polishing pad 1 may not be uniquely determined for a certain quantity of received light. For example, point P1 and point P2 in FIG. 8 indicate the same quantity of received light R1, but the associated thicknesses of the polishing pad 1 are T1 and T2, respectively, indicating different thicknesses. Therefore, the controller 50 compares a currently measured quantity of received light with a previously measured quantity of received light, and determines the thickness of the polishing pad 1 based on a magnitude relationship between the currently measured quantity of received light and the previously measured quantity of received light. In this case, the memory 50*a* of the controller 50 stores the previously measured quantity of received light. Since the quantity of received light at the point P1 is lower than the quantity of received light previously measured, the thickness of polishing pad 1 is determined to be T1. Since the quantity of received light at the point P2 is higher than the quantity of light received previously measured, the thickness of polishing pad 1 is determined to be T2.

Figure 9:
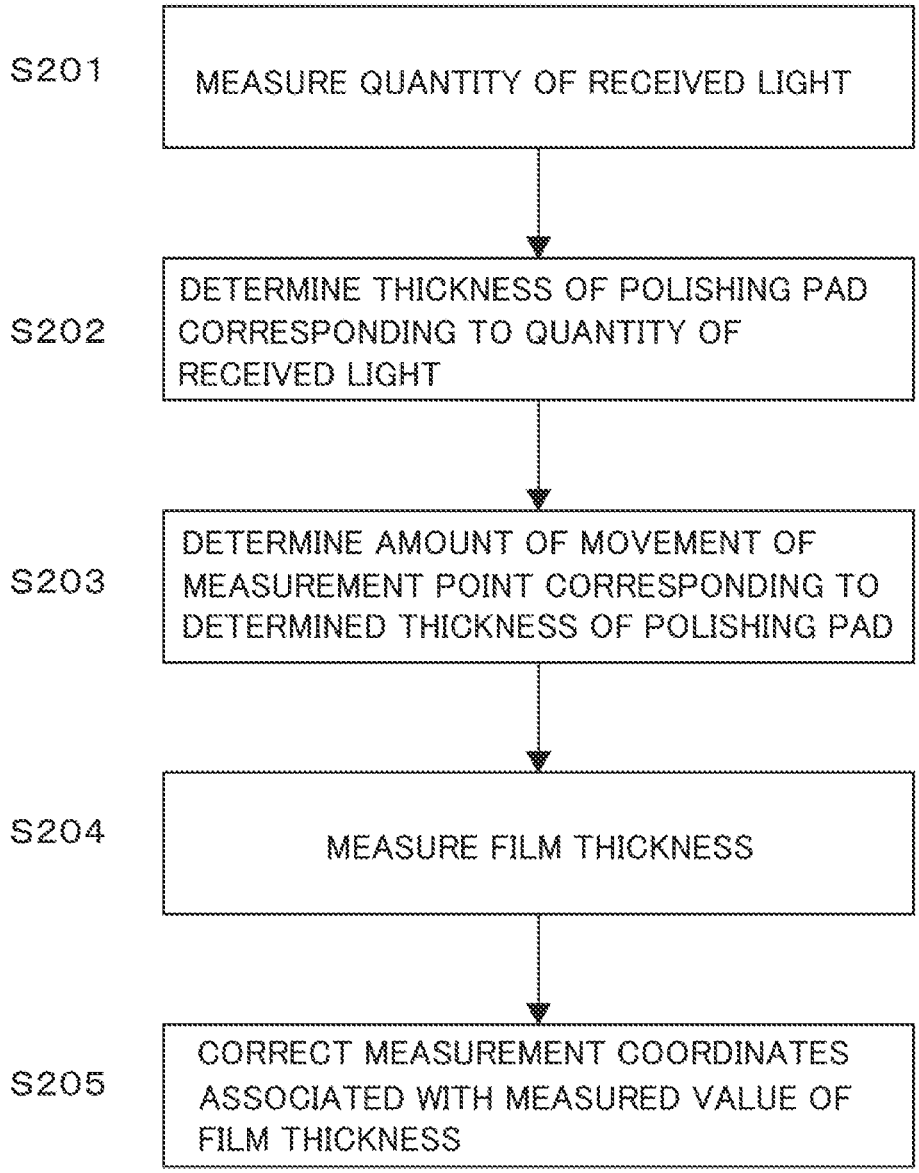
FIG. 9 is a flowchart showing operations of the polishing apparatus of the second embodiment.

FIG. 9 is a flowchart showing operations of the polishing apparatus in this embodiment. In step S201, the controller 50 measures the quantity of light received by the light-receiving optical fiber 33. Next, in step S202, the controller 50 determines the thickness of the polishing pad 1 corresponding to the measured value of the quantity of received light based on the second correlation data. Next, in step S203, the controller 50 determines the amount of movement of the measurement point corresponding to the determined thickness of the polishing pad 1 based on the first correlation data. Next, in step S204, the optical film-thickness measuring device 30 measures the film thickness, and the measurement coordinates are associated with the measured value of the film thickness. Next, in step S205, the controller 50 corrects the measurement coordinates associated with the measured value of the film thickness by the amount of movement of the measurement point determined in the step S203.

In FIG. 9, the steps S201 to S203 are executed before the step S204, but these steps may be executed simultaneously with the step S204. The steps S201 to S203 may be performed after the step S204. The step S201 and the step S204 may be executed when the optical sensor head 35 is located under the wafer W. In other words, when the top of the optical sensor head 35 (the light-emitting optical fiber 32 and the light-receiving optical fiber 33) is covered by the wafer W, the quantity of received light can be measured. For example, during polishing of the wafer W, the quantity of received light may be measured while the optical sensor head 35 is moving under the wafer W. Further, when the polishing of the wafer W is stopped, the optical sensor head 35 may be placed under the wafer W to measure the quantity of received light.

According to the present embodiment, the thickness of the polishing pad 1 can be determined based on the second correlation data and the measurement of the quantity of received light without using the configurations for measuring the thickness of the polishing pad 1. Furthermore, the amount of movement of the measurement point can be determined from the thickness of the polishing pad 1 using the first correlation data. As a result, the measurement coordinates associated with the measured value of the film thickness can indicate an accurate position.

Third Embodiment

In the second embodiment discussed above, the thickness of the polishing pad 1 is determined from the measured value of the quantity of received light based on the second correlation data, and the amount of movement of the measurement point is determined from the thickness of the polishing pad 1 based on the first correlation data. There is a relationship between the quantity of received light and the amount of movement of the measurement point based on a relationship between the first correlation data and the second correlation data. Therefore, in the third embodiment, the amount of movement of the measurement point is determined based on the quantity of received light. Configurations and operations of this embodiment, which are not particularly described, are the same as those of the first embodiment and the second embodiment described with reference to FIGS. 1 to 9, and thus redundant explanations will be omitted. Note that this embodiment can be executed by either the polishing apparatus shown in FIG. 1 or the polishing apparatus shown in FIG. 7.

In this embodiment, third correlation data indicating a relationship between the quantity of light received by the light-receiving optical fiber 33 and the amount of movement of the measurement point is used. For example, the third correlation data is stored in the memory 50*a* of the controller 50. The third correlation data is determined in advance through experiment. The arithmetic device 50*b* of the controller 50 determines the amount of movement of the measurement point from the measured value of the quantity of received light based on the third correlation data by executing arithmetic operation according to instructions included in the program. After the amount of movement of the measurement point is determined, the same processes as in the first embodiment and the second embodiment are performed. Specifically, the arithmetic device 50*b* of the controller 50 corrects the measurement coordinates based on the determined amount of movement of the measurement point.

Figure 10:
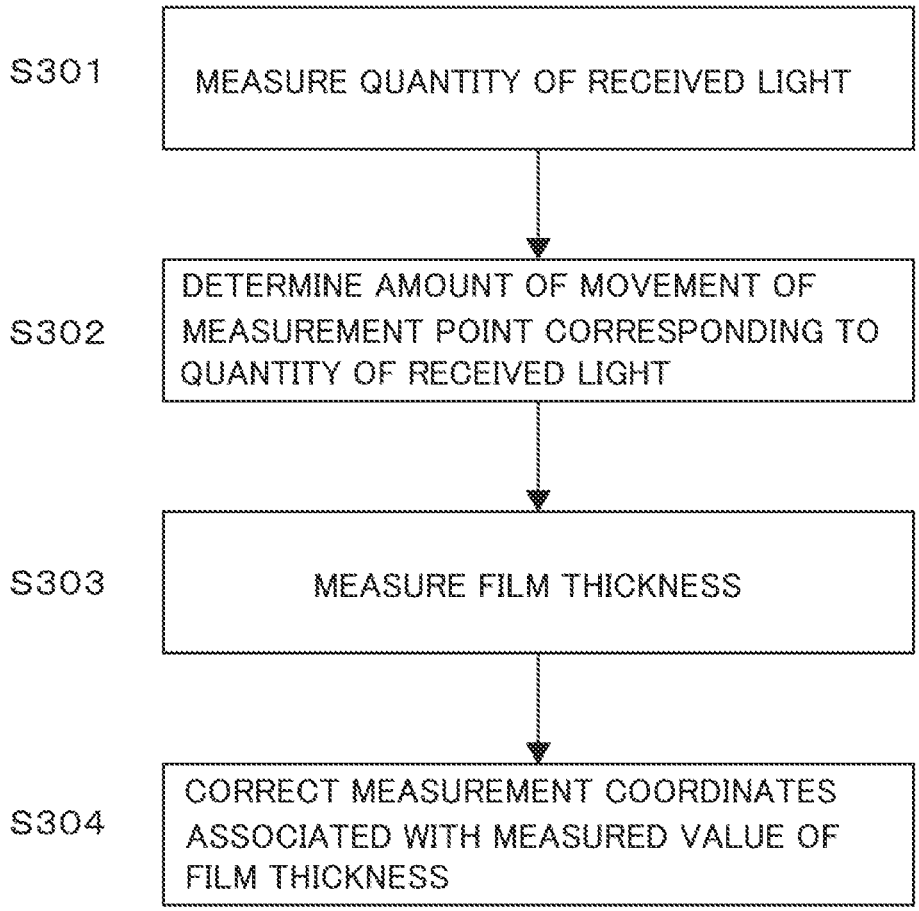
FIG. 10 is a flowchart showing operations of the polishing apparatus of a third embodiment.

FIG. 10 is a flowchart showing operations of the polishing apparatus in this embodiment. In step S301, the controller 50 measures the quantity of light received by the light-receiving optical fiber 33. Next, in step S302, the controller 50 determines the amount of movement of the measured value corresponding to the measured value of the quantity of received light based on the third correlation data. Next, in step S303, the optical film-thickness measuring device 30 measures the film thickness, and the measurement coordinates are associated with the measured value of the film thickness. Next, in step S304, the controller 50 corrects the measurement coordinates associated with the measured value of the film thickness by the amount of movement of the measurement point determined in the step S303.

In FIG. 10, the step S301 and the step S302 are executed before the step S303, but these steps may be executed simultaneously with the step S303. The step S301 and the step S302 may be performed after the step S303.

According to the present embodiment, the amount of movement of the measurement point can be directly determined based on the measured value of the quantity of received light and the third correlation data, without using the configurations for measuring the thickness of the polishing pad 1. As a result, the measurement coordinates associated with the measured value of the film thickness can indicate an accurate position.

In each of the above embodiments, an example has been described in which the thickness of the polishing pad 1 decreases, but the thickness of the polishing pad 1 may temporarily increase. For example, when the polishing pad 1 swells with the polishing liquid, its thickness temporarily increases. Even when the thickness of the polishing pad 1 increases, the above-mentioned correlations, i.e., the relationships defined in the first correlation data, the second correlation data, and the third correlation data hold true. Therefore, each embodiment can be applied even when the thickness of the polishing pad 1 increases.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

What is claimed is:

1. A polishing apparatus comprising:

a polishing table configured to support a polishing pad, the polishing table being rotatable;

a polishing head configured to press a substrate against a polishing surface of the polishing pad;

a pad-thickness measuring device configured to measure a thickness of the polishing pad;

an optical film-thickness measuring device configured to emit light obliquely to measurement points on the substrate, receive reflected light from the substrate, and determine measured values of film thickness at the measurement points based on the reflected light; and a controller configured to associate the measured values of the film thickness with measurement coordinates indicating positions of the measurement points, the controller including an arithmetic device configured to perform arithmetic operations including:

determining amount of movement of the measurement coordinates corresponding to a measured value of the thickness of the polishing pad based on correlation data indicating a relationship between the thickness of the polishing pad and the amount of movement of the measurement coordinates; and correcting the measurement coordinates associated with the measured values of the film thickness based on the determined amount of movement of the measurement coordinates.

2. The polishing apparatus according to claim 1, wherein the pad-thickness measuring device is configured to measure the thickness of the polishing pad when the pad-thickness measuring device is in contact with the polishing surface of the polishing pad.

3. The polishing apparatus according to claim 1, wherein the pad-thickness measuring device is arranged in the polishing table and is configured to measure the thickness of the polishing pad based on a height of a surface of the substrate that contacts the polishing surface.

4. The polishing apparatus according to claim 3, wherein the optical film-thickness measuring device includes an optical sensor head configured to emit the light to the substrate and receive the light from the substrate, the pad-thickness measuring device is configured to measure the thickness of the polishing pad based on the height of the surface of the substrate when both the pad-thickness measuring device and the optical sensor head are covered by the substrate pressed against the polishing pad.

5. The polishing apparatus according to claim 1, wherein the optical film-thickness measuring device includes a light-emitting optical fiber arranged to emit the light obliquely to the substrate, and a light-receiving optical fiber arranged to receive the light obliquely reflected off the substrate, and the light-emitting optical fiber has a diameter different from a diameter of the light-receiving optical fiber.

* * * * *